US006616553B1

(12) United States Patent
Tavares

(10) Patent No.: US 6,616,553 B1
(45) Date of Patent: Sep. 9, 2003

(54) NON-SYMMETRIC DIMPLE DEPTH PROFILE

(75) Inventor: Gary Tavares, Sturbridge, MA (US)

(73) Assignee: The Top-Flite Golf Company, Chicopee, MA (US)

( * ) Notice: Subject to any disclaimer, the term of this patent is extended or adjusted under 35 U.S.C. 154(b) by 0 days.

(21) Appl. No.: 09/252,979

(22) Filed: Feb. 19, 1999

(51) Int. Cl.[7] ..... A63B 37/12; A63B 37/14
(52) U.S. Cl. ..... 473/384; 473/378; 473/383
(58) Field of Search ..... 473/378, 383, 473/384

(56) References Cited

U.S. PATENT DOCUMENTS

| | | | | |
|---|---|---|---|---|
| 1,286,834 A | | 12/1918 | Taylor | |
| D59,366 S | | 10/1921 | Martin | |
| 1,656,408 A | | 1/1928 | Young | |
| D228,394 S | | 9/1973 | Martin et al. | |
| 4,681,323 A | | 7/1987 | Alaki et al. | |
| 4,787,638 A | * | 11/1988 | Kobayashi | 273/232 |
| 5,005,838 A | | 4/1991 | Oka | |
| 5,470,076 A | | 11/1995 | Cadorniga | |
| 5,503,398 A | | 4/1996 | Lu | |
| 5,536,013 A | | 7/1996 | Pocklington | |
| 5,735,757 A | * | 4/1998 | Moriyama | 473/384 |
| 6,039,660 A | * | 3/2000 | Kasashima et al. | 473/378 |

FOREIGN PATENT DOCUMENTS

| | | |
|---|---|---|
| EP | 0 536 725 A1 | 4/1993 |
| GB | 2327890 | 2/1999 |
| WO | WO 00/33921 | 6/2000 |

* cited by examiner

*Primary Examiner*—Richard Chang

(57) ABSTRACT

A nets configuration for the dimples on the surface of a golf ball is characterized by at least a portion of the bottom surface of the dimple extending below a radius of curvature which defines the concavity of the dimple. Thus, the dimples have a non-symmetric depth profile. The dimples are preferably circular and the non-symmetrical portions are maintained within one half of the dimple.

9 Claims, 3 Drawing Sheets

NON-SYMMETRIC DIMPLE DEPTH PROFILE

BACKGROUND OF THE INVENTION

The present invention relates to a new configuration for the dimples on a golf ball surface which improve the flight characteristics of the ball.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF DESCRIPTION OF THE PRIOR ART

Various dimple configurations have been provided in order to improve the aerodynamic properties of a golf ball as it travels through the air. In the Sullivan U.S. patent application Ser. No. 09/259,673 there is disclosed a golf ball with contoured dimples, wherein a portion of a dimple is filled-in to provide a dimple of variable depth. In the Sullivan U.S. patent application Ser. No. 09/259,673, a golf ball having a plurality of dimples of different depth is disclosed. Groups of similar dimples are arranged within a geometric pattern on the ball, with the groups having increasing or decreasing depth. Both of the Sullivan inventions are commonly owned with the present invention.

The present invention was developed in order to provide a further dimple configuration wherein the dimples have a non-symmetric profile in order to improve the aerodynamic properties of a golf ball.

SUMMARY OF THE INVENTION

Accordingly, it is a primary object of the invention to provide a golf ball having a spherical surface which contains a plurality of dimples, each of the dimples having an outer edge at the intersection with the ball surface and a bottom surface defining a concavity. The bottom surface has a radius of curvature, and a portion of the bottom surface extends below the radius of curvature to define a nonsymmetric depth profile.

According to another object of the invention, the outer edge of the dimples has a circular configuration and the portion of the dimple extending below the radius of curvature is contained within one half of the dimple.

According to a further object of the invention, the dimples having a nonsymmetric depth profile are arranged in a geometric pattern on the surface of the golf ball.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
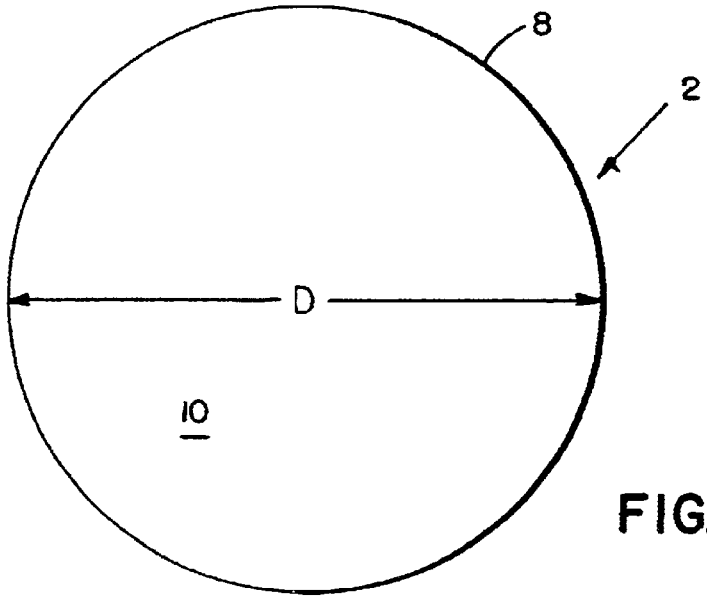
FIG. 1 is a top plan view of a circular dimple.
Figure 2:
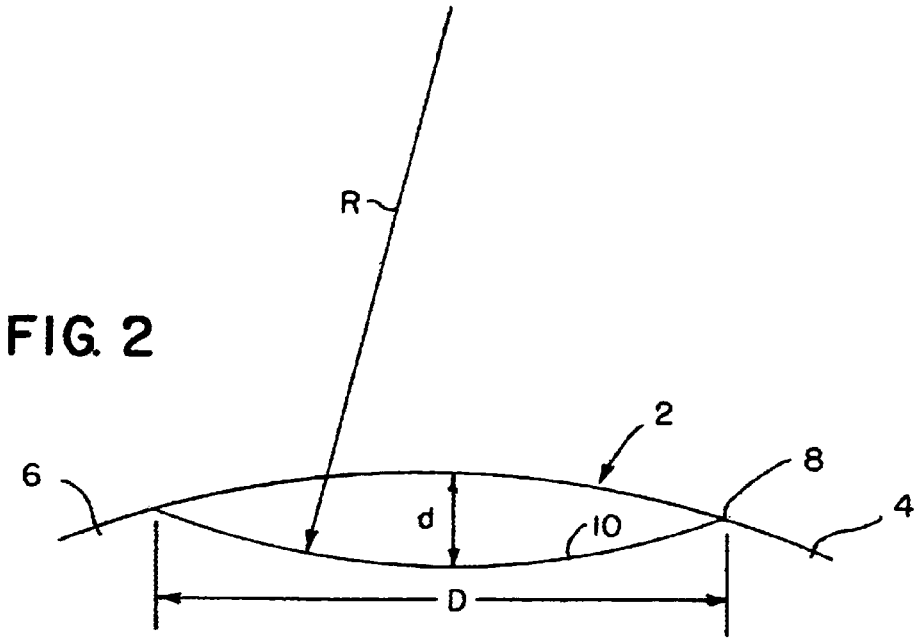
FIG. 2 is a sectional view of a conventional circular dimple showing its diameter and depth.

In FIGS. 1 and 2 are shown a circular dimple 2 which is formed in the spherical surface 4 of a golf ball 6. The dimple has an edge 8 defined where the dimple intersects with the surface of the ball. In the conventional dimple shown in FIG. 2, the bottom surface 10 of the dimple is a concavity having a radius of curvature R, a depth d defined as the maximum difference between the radius of the ball at the surface and the radius at the bottom of the dimple, and a diameter D measured across the dimple between where the edges thereof intersect the surface of the ball. The conventional dimple is symmetric throughout its bottom surface 10.

Figure 3:
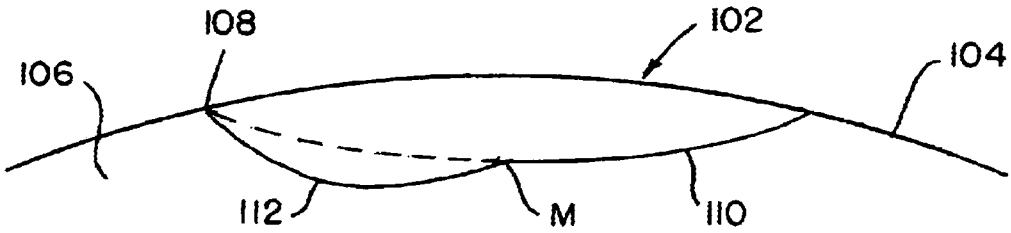
FIG. 3 is a sectional view of a dimple having a non-symmetric depth according to a first embodiment of the invention.

Turning now to FIG. 3, there is shown the profile of a non-symmetric depth dimple 102 according to a first embodiment of the invention. The bottom surface 110 of the dimple has a radius of curvature defining a concavity in the surface 104 of a golf ball 106. A portion 112 of the bottom surface extends below the radius of curvature (which is represented by the dashed lines extended along the arc of the surface 110) so that the depth profile of the dimple 102 is non-symmetric.

The edge 108 of the dimple 102 preferably has a circular configuration as shown in FIG. 1. However, other configurations may be provided including oval, elliptical, tapered, and the like. A line through the midpoint M in the bottom surface of the dimple divides the dimple into two halves. Preferably, the portion 112 below the radius of curvature is contained within in one half of the bottom surface of the dimple.

Figure 4:
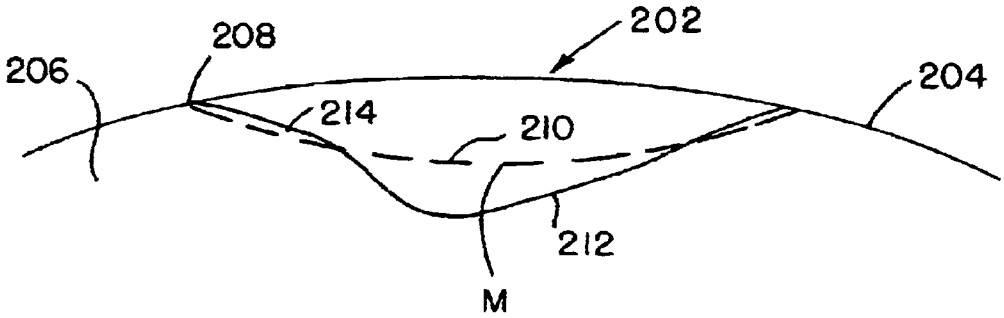
FIG. 4 is a sectional view of a dimple having a non-symmetric depth according to a second embodiment of the invention.

In FIG. 4 is shown an alternate dimple 202 having a non-symmetric depth profile. The radius of curvature is represented by the dashed line 210. A portion 212 of the bottom surface of the dimple extends below the radius of curvature. As distinguished from the dimple of FIG. 3, a further portion 214 of the dimple bottom surface is contoured above the radius of curvature to "fill-in" a portion of the dimple and add to its non-symmetrical profile. As shown in FIG. 4, the contoured portion 214 is maintained below the surface 204 of the ball 206. If desired, the contoured portion 214 can surround the portion 212, although the contour around the perimeter of the portion 212 need not be symmetrical. Alternatively, the contoured portion can be restricted to one-half of the dimple as defined by the midpoint M. In the other half, beyond the portion 112, the bottom of the dimple can be along the radius of curvature.

Figure 6:
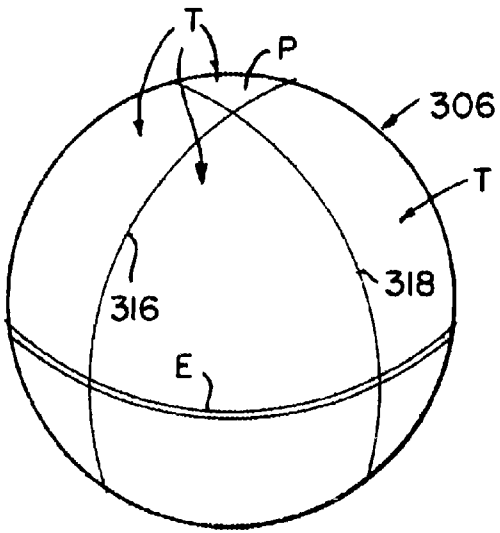
FIGS. 5 and 6 are plan views, respectively, of a spherical golf ball illustrating the manner of defining a geometric pattern on the surface of the ball.
Figure 5:
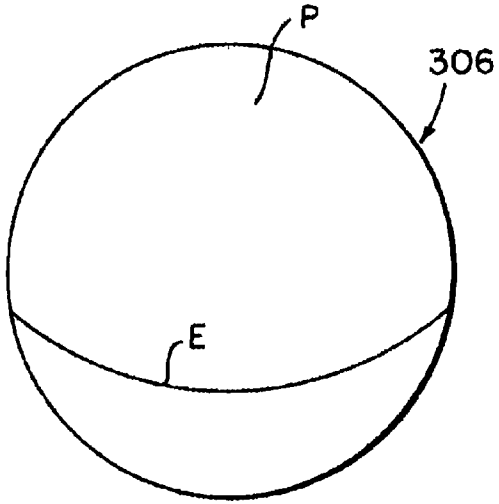

Referring now to FIGS. 5 and 6, the golf ball 306 according to the invention has a spherical configuration formed by injection molding in a cavity defined between two separable molding plates. Each plate has a hemispherical cavity, the cavities being adapted to mate when the plates are brought together. Thus, the golf ball has an equator E at the juncture of the molding plates which divides the ball into two identical hemispheres, each of which contains a pole P. Imaginary great circles are arranged on the surface of the ball and pass through the poles to divide the ball surface into a geometric pattern of equal sections or geometries. In FIG. 6, two circles 316, 318 are shown which divide each hemisphere into four equal triangles T. Other geometric patterns can be defined on the surface of the ball in accordance with the invention. For example, a third great circle through the poles would divide each hemisphere into six triangular geometries.

Figure 7:
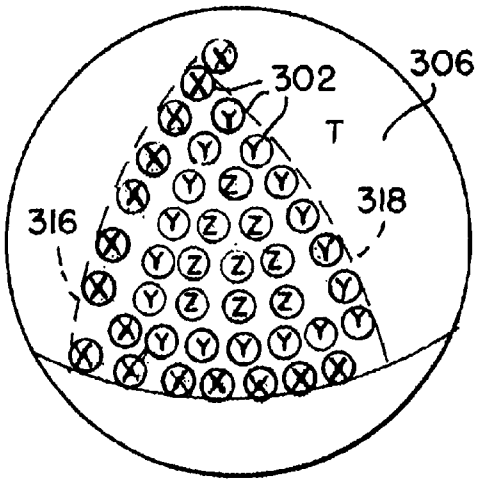
FIG. 7 is a plan view of a golf ball according to the invention including groups of dimples of non-symmetric depth arranged in a geometric pattern.

Each of the triangles T is filled with a plurality of non-overlapping dimples 302 as shown in FIG. 7. A pattern of dimples is arranged within the triangle T. The dimples are all circular and may have the same diameter. Three groups X, Y, Z of dimples are shown in FIG. 7. The first group of dimples X for example may comprise symmetric dimples such as those shown in FIG. 2. The second group of dimples Y may comprise non-symmetric dimples such as those shown in FIG. 3, and the third group of dimples Z may comprise non-symmetric dimples with contour portions such as those shown in FIG. 4. Any combination of the various types of dimples may be provided within the triangle in any desired pattern.

The golf ball 306 incorporating the dimples having non-symmetric depth profiles has improved aerodynamic properties because of the manner in which air flows across the surface of the ball and within the dimples The improved properties are increased length and less of a susceptibility to slice or draw.

While in accordance with the provisions of the patent statute, the preferred forms and embodiments of the invention have been illustrated and described, it will be apparent to those of ordinary skill in the art that various changes and modifications may be made without deviating from the inventive concepts set forth above.

What is claimed is:

1. A dimple arranged in a spherical surface of a golf ball, comprising a bottom surface defining a concavity having an outer edge at an intersection with the spherical surface, said bottom surface having a continuous profile including a first portion extending continuously from a first location at the outer edge at the intersection with the spherical surface and a second portion extending continuously from a second location on the dimple edge opposite the outer edge at the intersection with the spherical surface of said first location, said first and second portions meeting alone said profile, said first continuous portion having a constant radius relative to a point beyond the spherical surface on a radial line extending from a center of the golf ball through a center of the dimple and a said second continuous portion being spaced from said point by a variable distance greater than said radius, thereby to define a non-symmetric depth profile.

2. A dimple as defined in claim 1, wherein the concavity has a circular configuration at the intersection thereof with the surface of the ball.

3. A dimple as defined in claim 2, wherein said first portion is contained within one half of said dimple, and said second portion is contained in another half of said dimple.

4. A golf ball having a spherical surface containing a plurality of dimples, each of said dimples comprising an outer edge at an intersection with the spherical surface of the ball and a bottom surface defining a concavity in the spherical surface, at least one of said dimples having a bottom surface depth profile including a first portion extending continuously from a first location at an edge of the dimple the outer edge at the intersection with the spherical surface and a second portion extending continuously from a second location on the dimple edge opposite the outer edge at the intersection with the spherical surface of said first location, said first and second portions meeting along said profile, said first continuous portion having a constant radius relative to a point beyond the spherical surface on a radial line extending from a center of the golf ball through a center of the dimple, and said second continuous portion being spaced from said point by a variable distance greater than said radius, thereby to define a non-symmetric depth profile in said at least one of said dimples to improve aerodynamic properties of the golf ball.

5. A golf ball as defined in claim 4, wherein said outer edge of said dimples have a circular configuration.

6. A golf ball as defined in claim 5, wherein said first portion is contained within one half of said dimple and said second portion is contained in another half of said dimple.

7. A golf ball as defined in claim 5, wherein said dimples having a non-symmetric depth profile are arranged in a geometric pattern on the surface of the golf ball.

8. A golf ball as defined in claim 7, wherein the dimples within a geometric pattern are positioned in symmetric groupings.

9. A golf ball as defined in claim 8, wherein all of said dimples on the surface of the golf ball have a non-symmetric depth profile.

* * * * *